United States Patent [19]

Wiegand

[11] 4,449,558

[45] May 22, 1984

[54] METHOD AND APPARATUS FOR TRIMMING WOODEN BOARDS

[75] Inventor: Karl-Wolfram Wiegand, Bochum, Fed. Rep. of Germany

[73] Assignee: Dimter GmbH Maschinenfabrik, Illertissen, Fed. Rep. of Germany

[21] Appl. No.: 296,313

[22] Filed: Aug. 26, 1981

[30] Foreign Application Priority Data

Dec. 27, 1980 [DE] Fed. Rep. of Germany ..... 3049258

[51] Int. Cl.[3] ..... B27M 1/08; B27B 1/00

[52] U.S. Cl. ..... 144/367; 83/278; 83/471.2; 144/3 R; 144/357

[58] Field of Search ..... 144/2 R, 356, 357, 377, 144/378, 367; 83/471.1, 471.2, 488, 278, 282

[56] References Cited

U.S. PATENT DOCUMENTS 4,240,477 12/1980 Horn et al. ..... 244/357

*Primary Examiner*—W. D. Bray

*Attorney, Agent, or Firm*—Staas & Halsey

[57] ABSTRACT

A method and apparatus for trimming boards, wherein a first stage, a first mechanism initially fixes and cuts two positioning short end cuts for each board. These positioning short end cuts are then used for advancing the board into the corresponding cutting plane of a second mechanism for trimming the board. As a result, it is possible to take into account the natural growth of a tree (all trees become thinner towards the top) and produce the minimum of trimmed waste. Because the natural growth of a tree to a conical shape, the positioning end cuts of a board will frequently define two non-parallel cutting lines for the edges of the board. The trimming in the second mechanism can be performed by different tools, e.g. by saws or one or more milling cutters. If a milling cutter is used, the boards can also be positioned in such a way that the sloping edges of the board resulting from the substantially circular cross-section of a tree can be taken into account. i.e., an inclined trimming takes place, taking into account the natural shape of the board so that there is a minimum of waste in this trimming dimension. If two cutters are used, the two stepped milling tools can be arranged in such a way that the largest diameter portion of one cutter is associated with the smallest diameter portion of the other cutter. In this case, the cut profiles on the edges of two adjoining boards that are cut by the two cutters match one another and fit together, so that without further manipulation, gluing in a joint gluing installation is possible. The boards are transported through the trimming mechanism in the desired manner by a pair of stops, a slide and a pair of ejectors. These members function in such a way that the desired cutting quality and shape are obtained for the board, while producing minimum waste.

13 Claims, 5 Drawing Figures

METHOD AND APPARATUS FOR TRIMMING WOODEN BOARDS

BACKGROUND OF THE INVENTION

The invention relates to a method and to an apparatus for trimming wooden boards.

Basically, untrimmed boards have a conical shape because the tree trunk from which they are sawn is also conical. If the boards are to be used to form larger width wooden panels by gluing in a joint gluing installation, the boards must be trimmed. This can, for example, be achieved by passing the boards between two parallel-arranged saws. However, this method and apparatus leads to a great deal of waste because the total board width is determined by the narrowest point along the board. Attempts have been made to conically cut the boards in order to reduce waste. However, the known methods and apparatuses have proved unsatisfactory with regard to cutting quality and capacity. Particularly when cutting hard wood, it is necessary to secure the board during sawing, i.e. the saw performs the relative movement while the board is held stationary.

In addition, due to the substantially circular cross-section of a tree, the boards are not cross-sectionally precisely rectangular. Instead one planar board surface is wider than the other. If when trimming, a straight edge is cut, then the larger planar surface of the board is reduced to the size of the smaller planar surface, leading to additional waste.

BRIEF SUMMARY OF THE INVENTION

The object of the invention is to overcome the problems of the prior art by providing a method and apparatus for trimming wooden boards having a high capacity, good cutting quality and low waste.

According to the invention, the untrimmed boards are initially positioned with the aid of a special positioning mechanism for fixing and cutting two positioning short end edge cuts for each board, their straight connecting line giving a clean cutting edge along the board in the subsequent trimming stage. The board prepared in this way is then transported to a special trimming mechanism having of a pair of stops and a slide for positioning a board into a first cutting plane, the pair of stops being correspondingly associated with the cutting plane, i.e. the pair of stops always performs a specific stroke perpendicular to the cutting plane ensuring that the associated positioning end cuts of the board come into the cutting plane. A pair of ejectors moves the board out of the area of the first cutting plane with the rear edge into a second cutting plane. The front edge of one board is always simultaneously cut with the rear edge of the preceding board.

The invention can also be used for finishing wood, particularly hard wood which has already been trimmed. The intermediate storage of trimmed wood leads in certain circumstances to serious warping. As a result, the cutting edge is deformed, so that a completely satisfactory gluing is no longer possible. In this case, further trimming can be carried out optionally with the aid of a special cutting tool. There is no need to use the positioning mechanism.

The cutting plane in the special trimming mechanism is fixed by the cutting tool or tools and the latter can be of different types. For example, each edge of the two boards to be cut can be cut by a separate cutting tool using a saw or a milling cutter. However, it is also possible to fix both cutting planes for the edges of the two boards to be cut by a single tool, e.g. a single milling cutter positioned between the two boards and rotating about a vertical axis.

In a particularly advantageous manner, two milling cutters rotating about a vertical axis can be provided between the two boards. The cutting profiles of the milling cutters are stepped and arranged in such a way that the largest diameter portion of one cutter is associated with the smallest diameter portion of the other cutter and both cutters can be displaced relative to one another in the feed direction.

As a result, it is possible to provide the front edge of one board with a corresponding stepped profile in the first cutting plane. The rear edge of this board after advancing it into the second cutting plane is provided with a corresponding profile matching the previously cut profile by means of the other milling cutter arranged in a "reverse" manner. If the boards are then fed to a joint gluing installation, they match one another with the stepped, cut profiles. This method and apparatus permits good gluing between the boards and saves a step of rotating every other before the gluing step.

If only one milling cutter is used between the two boards for both cutting planes with a stepped profile, the boards can be fed in such a way that the larger planar surfaces of the boards are located in the vicinity of the smallest diameter of the cutter, so that only the minimum necessary amount of material is cut from the edges sloping due to natural growth. In this case, although the profiles between the two boards do not directly match one another for gluing purposes, less material is removed during cutting. If gluing in a joint gluing installation is required between the boards, every other board must be reversed.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

The apparatus according to the invention comprises two main mechanisms, the first mechanism (FIG. 1) for fixing and cutting positioning short end cuts on the board to be trimmed and the second mechanism (FIG. 2) for trimming the boards.

Figure 1:
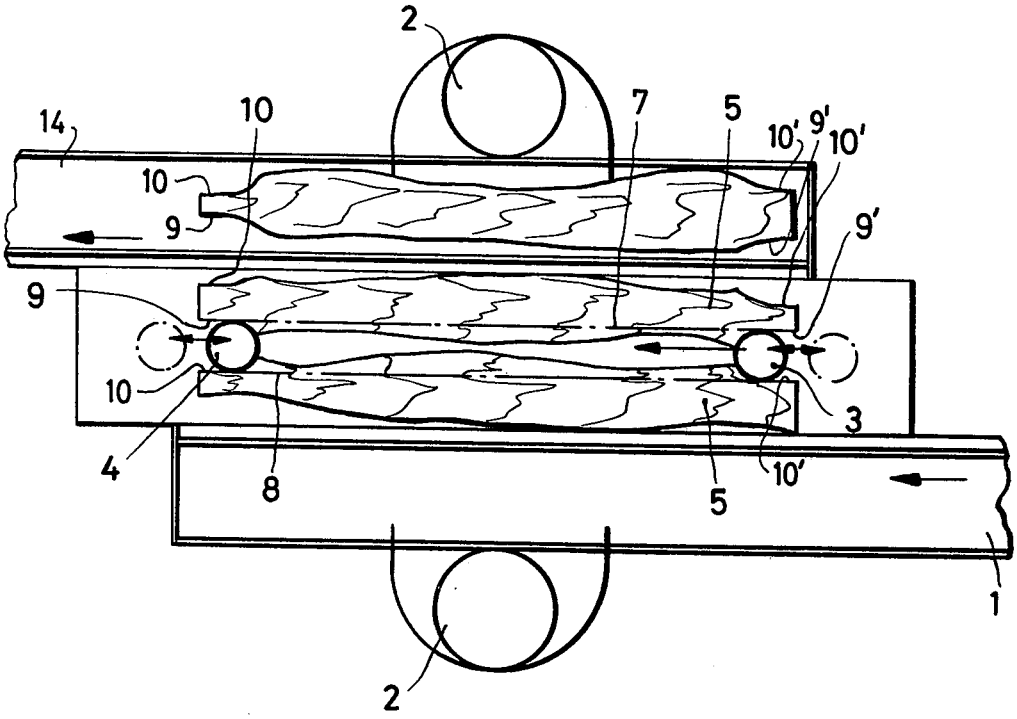
FIG. 1 is a diagrammatic plan view of a device for fixing and cutting the positioning the short end cuts on the boards to be trimmed.

The first positioning mechanism shown in FIG. 1 comprises a roller conveyor 1 for feeding the boards 5 to be trimmed to a workbench. The standing positions for the operators of the positioning mechanism are designated by reference elements 2. Two direction fixing and cutting shadows 7 and 8, which form a straight line, and used in conjunction with milling; cutters 3 and 4. One milling cutter, e.g. cutter 3, is adjustable in the manner indicated by the arrow in FIG. 1, in order to adapt to varying lengths of the boards. Two boards 5 are arranged on the workbench in such a way that the shadows 7 or 8 fix the desired cutting lines for the boards. The cutters 3 and 4 are then operated and cut positioning short cuts 9, 9' and 10, 10' on the two ends of each board. The short end cuts 9, 9' and 10, 10' each define and fix the boards in subsequent trimming straight cutting lines for.

Figure 2:
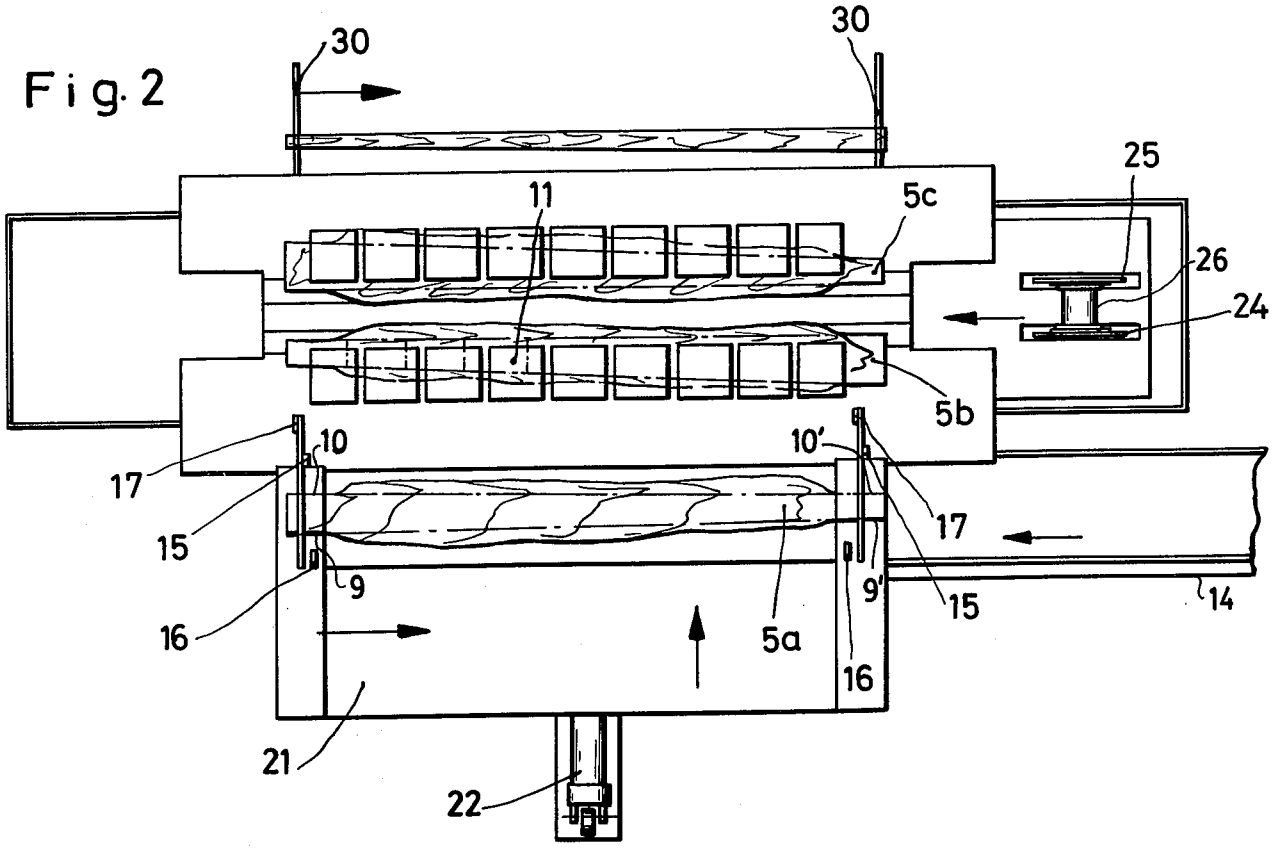
FIG. 2 is a plan view of a trimming apparatus approximately at the working level.
Figure 3:
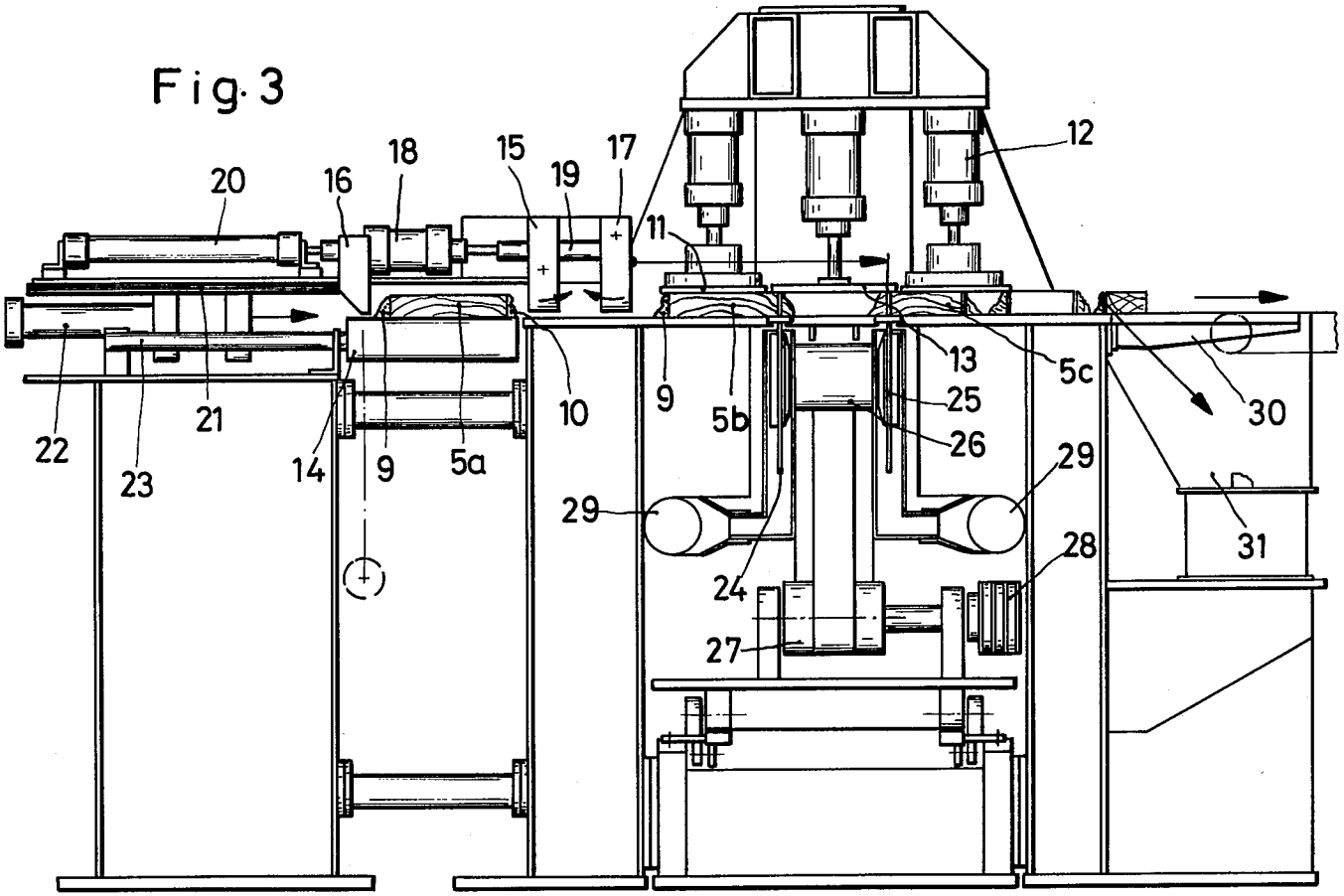
FIG. 3 is a part sectional side view through an embodiment of the invention.

The second trimming mechanism comprises a roller conveyor 14 for conveying the boards with fixed positioning end cuts 9, 9' and 10, 10' from the positioning mechanism shown in FIG. 1 into the working area of the trimming mechanism shown in FIGS. 2 and 3. A carraige 21, which is moved backwards and forwards with the aid of a drive device 22 and a guide 23 substantially perpendicular to the longitudinal extension or length of the boards to be trimmed, carries a pair of stops 15, a slide 16 and a pair of ejectors 17.

Slide 16, which in this embodiment, comprises a pair of slides, can also be moved backwards and forwards, in addition to the carriage, by means of a drive device 20 positioned on the carriage.

The pair of stops 15 and pair of ejectors 17 are pivotably mounted on the carriage 21 in the manner indicated by the arrows. The pivoting movement is performed by a pneumatic cylinder 18 and corresponding linkage mechanism 19.

Saws 24, 25 are circular saws mounted through a mounting device 26, connected to a drive device 28 and which assembly can be moved up and down by tilting the assembly around the shaft of the drive device 28 using the aid of a bearing 27. A suction device 29 is also provided. A clamping device 11 is associated with saw 24 and clamping device 12 with saw 25. A braking mechanism 13 is provided for preventing an undesired advance of the boards.

The trimmed boards are moved out of the trimming mechanism of the apparatus at supports 30. The trimmed waste falls into a container 31 or conveyor belt. Due to the use of the positioning end cuts on the boards provided by the first mechanism, the trim waste is shorter than the remaining board and therefore falls through between the supports 30. In operation, the boards provided with positioning end cuts 9, 9' and 10, 10' are conveyed by roller conveyor 14 to the trimming mechanism. A board is thus first located in a position **5*a* in the trimming mechanism as best shown in FIG. 2. Slides 16, by activation of drive device 20, moves the board with the positioning end cuts now in the position 5*a* against the corresponding stops of the pair of stops 15. Slide 16 preferably comprise a pair of slides (cf FIG. 2) so that they engage the previously prepared positioning end cuts 9 and 9' of the board. Fundamentally, it is sufficient, however, if the slides 16 ensure that the board is moved against the pair of stops of pair 15. When this position is reached, the two positioning end cuts 10, 10' of the board are contacting the stops 15 and the proposed cutting line for the board between 10 and 10' is already parallel to the cutting plane of saw 24. Together with the carriage 21, this board is then advanced to the position 5*b* by activation of drive device 22. A board already located in position 5*b* under clamping device 11 and whose front edge has already been trimmed in position 5*b* is advanced into position 5*c* by the pair of ejectors 17. The pair of ejectors 17 engage the positioning end cuts 9 and 9' of the board in position 5*b* and the proposed cutting line of the board between the ends 9 and 9' corresponds and is parallel to the cutting plane of saw 25**.

The pair of stops 15 and pair of ejectors 17 perform the stroke indicated by the arrow as shown in FIG. 3. The pair of stops 15 are parallel to the cutting plane of saw 24 and the ejectors of pair 17 parallel to the cutting plane of saw 25. The distance between the stop pair and ejector pair is constant and corresponds to the distance between the cutting planes of the two saws 24, 25.

Due to the fact that the pair of stops 15 are parallel to the cutting plane of saw 24 and always perform the same stroke, it is ensured that the proposed cutting line fixed by positioning end cuts 10, 10' of a board is precisely located in the cutting plane of saw 24. On moving the board, whose front edge is already trimmed, from position **5*b* into position 5*c* by the ejectors 17 (as shown by the arrow in FIG. 3), it is ensured that at the end of this movement the rear edge of the board, i.e. the proposed cutting line between positioning end cuts and 9, 9', is parallel to the cutting plane of the second saw 25. In each case, two cuts are simultaneously made on two different following boards by saws 24 and 25 moving between the two boards in the direction indicated by the arrow shown in FIG. 2** and as known in the art. As a result of parallel cuts, conical boards are produced.

When stop pair 15 and ejectors pairs 17 move back into their initial position, the stops and ejectors are swung up with the aid of pneumatic cylinder 18 and the linkage mechanism 19, as indicated by the small arrows in FIG. 3. When the boards have reached their position **5*b* or 5*c* due to the movement of the pair of stops and the pair of ejectors, they are secured by clamping devices 11 and 12, so that carriage 21 can perform its return stroke. On the carriage 21 reaching its initial position (shown in FIG. 3), a further board is supplied by the roller conveyor 14 to the position 5*a*** and a new working stroke can commence.

The apparatus according to the invention permits the simultaneous trimming of two edges of two boards, the boards being secured and unable to move. The saws perform the relative movement to the boards in cutting the lengths of the board and, even in the case of hard wood, ensure a clean cut. The parts of the trimming mechanism, namely the pair of stops and pair of ejectors, which move the boards into the area of the cutting planes of the saws can be moved back immediately after performing this movement and the boards can then be secured. The stops and ejectors are then ready to advance a new board when the cutting operation of the saws is ended. The pair of stops and pair of ejectors do not impede sawing. Trimming can be performed completely automatically with a high output level per unit of time.

One stop 15, one slide part 16 and one ejector 17 on one side (e.g. the left-hand side in FIG. 2) are adjustable at right angles to the working direction, as indicated by an arrow, to adapt to varying lengths of boards. The support 30 for conveying the trimmed boards away is correspondingly adjustable.

Figure 4:
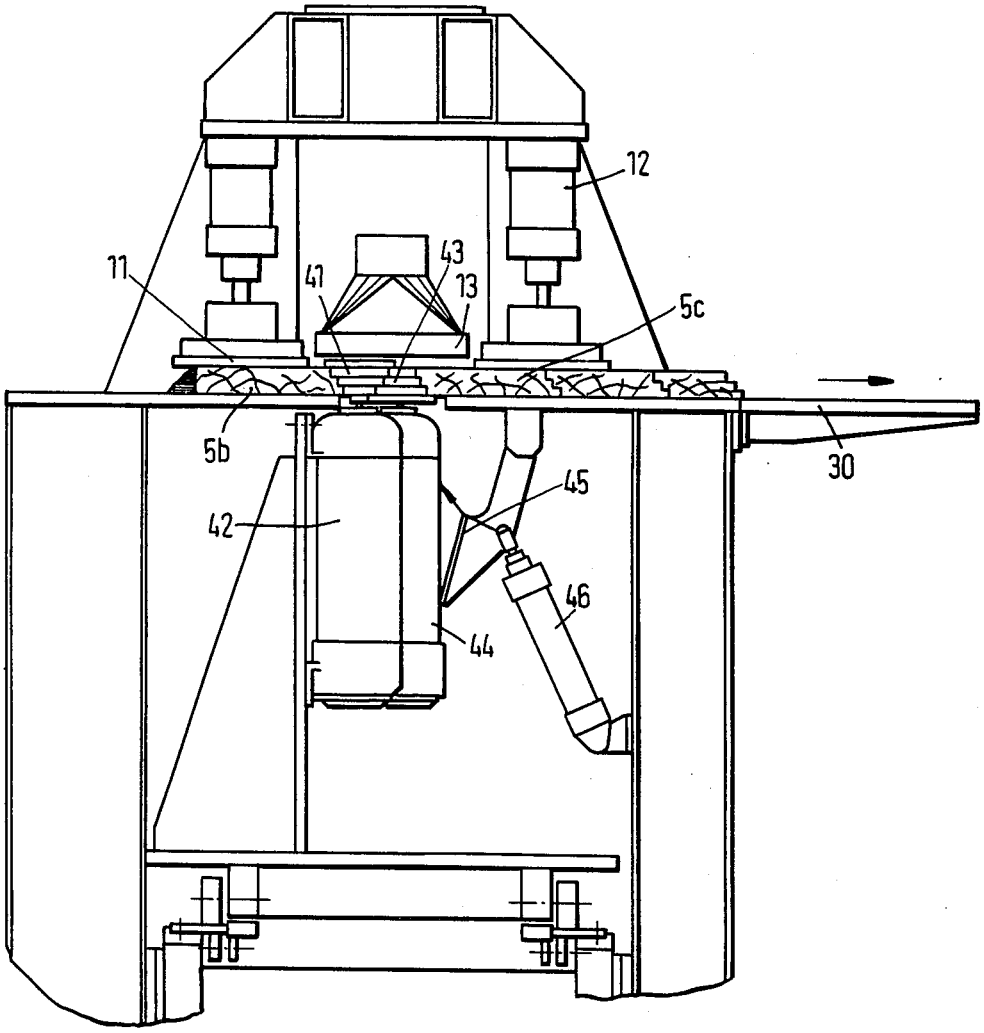
FIG. 4 is a view corresponding to FIG. 3, but through another embodiment of the invention.

The embodiment of FIG. 4 only differs from those according to FIGS. 1 to 3 in that milling cutters are used instead of the two saws. Two milling cutters 41, 43, which rotate about a vertical axis, are provided and have a stepped profile, as is shown in FIG. 4. They are driven by motors 42, 44. It is apparent that the cutters are displaced relative to one another in the feed direction.

On comparing FIGS. 3 and 4, it becomes apparent that a larger slot in the working plane results from the use of cutters. Following each cutting process, therefore, a plate 45 actuated by a cylinder 46 pivots into this slot.

In operation, the apparatus of FIG. 4 fundamentally operates in the same way as those according to FIGS. 1 to 3. As the two milling cutters 41, 43 are arranged in such a way that the largest diameter portion of milling cutter 41 is associated with the smallest diameter portion of the other cutter 43, the front edge of the board in position 5*b* is provided with a stepped profile corresponding to the shape of cutter 41. When this board is advanced into position 5*c*, cutter 43 produces a "reverse" profile on the rear edge of the board, which matches the first profile. Thus, two boards adjcent each other have matching profiles for fitting into each other. Thus, without further turning and reversing, gluing is possible in a joint gluing installation and simultaneously a firm joint can be formed between two adjoining boards.

Figure 5:
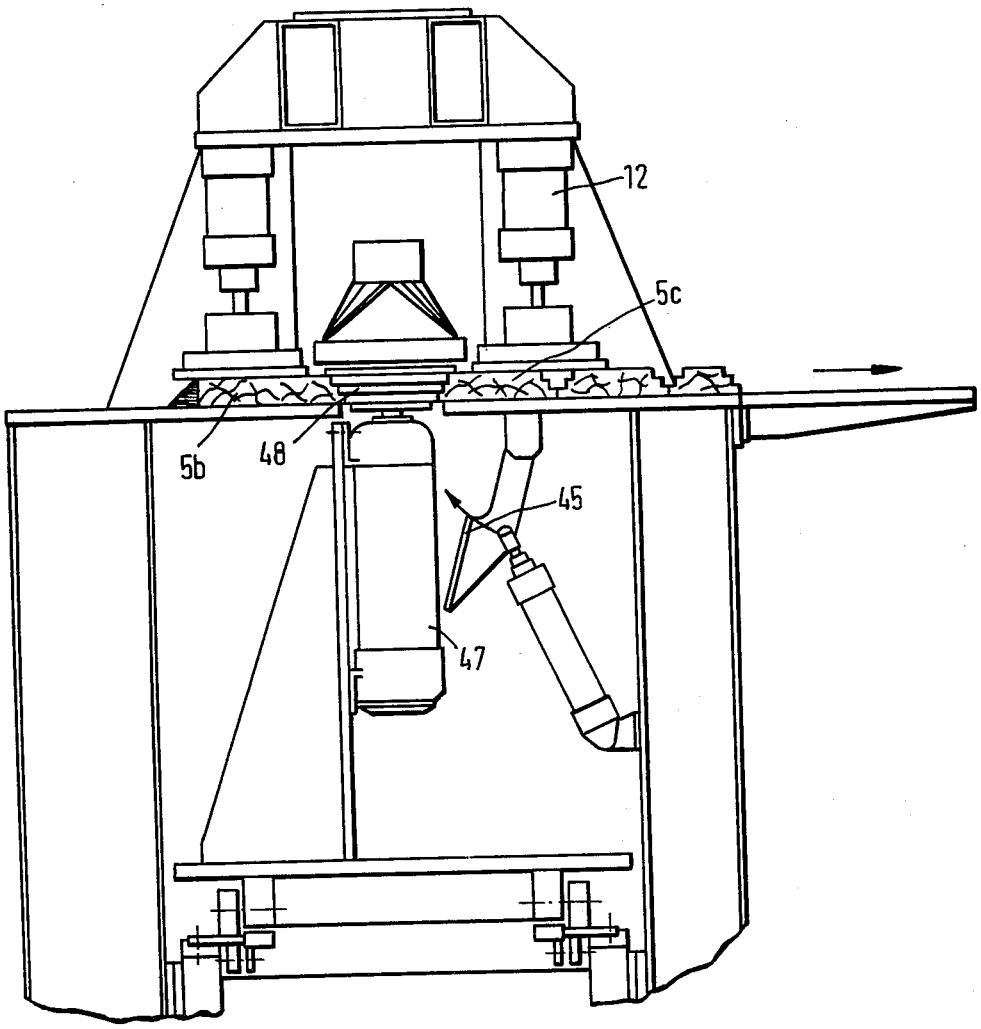
FIG. 5 is a side view corresponding to FIGS. 3 and 4, but through a further embodiment of the invention.

In the embodiment of FIG. 5, there is only one milling cutter 48, which rotates about a vertical axis and also has a stepped profile. On working with such a cutter, the cutting operation on the two boards is performed at the same time in both cutting planes by a single tool, i.e. cutter 48. The boards are preferably inserted in such a way that their larger planar surfaces, resulting from the slope on the sides due to natural tree growth, are associated with the smallest diameter portion of cutter 48. In FIG. 5, the larger planar surface of the board is at the bottom. The milling cutter then produces a chamfered profile on the front and rear edges corresponding to the shape resulting from the natural roundness of the tree, so that a minimum amount of trim material is cut off. Although the profiles of the adjoining trimmed boards do not match with one another (cf FIG. 5), it is possible to reverse every other board, thereby permitting gluing between two adjoining boards.

The question of whether the apparatus of FIG. 5 or that of FIG. 4 is used, depends on the requirements which are given preference. When working with the apparatus of FIG. 4, somewhat more material is removed, but then joint gluing without further manipulations is possible. On working with the apparatus of FIG. 5, the waste is less, but gluing in a joint gluing installation can only take place by reversing every other board.

Fundamentally, the invention is directed at the trimming of unfinished boards. However, due to intermediate storage, already trimmed boards may warp, so that they are not suitable for direct gluing. To ensure completely satisfactory gluing, further slight trimming is required. In this case, positioning by a first mechanism according to FIG. 1 is not necessary, because only a small amount of material has to be cut, optionally by a special tool.

What is claimed is:

1. A method for trimming wooden boards comprising the steps of: fixing and cutting two positioning short cuts at the ends of each longitudinal edge of the boards to be cut and trimming the boards wherein the positioning short end cuts of one longitudinal edge of the board are used to move that longitudinal board edge into a first cutting plane of a cutting device and the positioning short end cuts of the other longitudinal edge of the board are used to move that longitudinal board edge into a second cutting plane of the cutting device.

2. An apparatus for trimming wooden boards comprising: means for fixing and cutting two positioning short cuts at the ends of each longitudinal edge of the board for defining a proposed trimming line therebetween and means for trimming the longitudinal edges of the board using the positioning short end cuts, said trimming means including cutting means for cutting the front longitudinal edge of a board along a first cutting plane and the rear longitudinal edge of the board along a second cutting plane, stop means for engaging the positioning short end cuts of the untrimmed front longitudinal edge of the board and which stop means is associated with and parallel to the first cutting plane of the cutting means for cutting the front longitudinal edge of the board, slide means for advancing the board and moving the positioning short end cuts of the front longitudinal edge of the board against the stop means, ejector means for engaging the positioning short end cuts of the untrimmed rear longitudinal edge of the board, and which ejector means is associated with and parallel to the second cutting plane of the cutting means for cutting the rear longitudinal edge of the board, wherein the slide means, stop means and ejector means are jointly displaceable and move the rear longitudinal edge of a first board into the second cutting plane of the cutting means and move the front longitudinal edge of a second board into the first cutting plane of the cutting means and wherein the cutting means cuts the rear and front longitudinal edges of the two respective boards along the proposed trimming lines defined between the positioning short cuts at the ends of the rear and front longitudinal edges of the two respective boards.

3. An apparatus according to claim 2, wherein the stop means and ejector means are arranged so that they can be pivoted out of the working area of the boards in the trimming means.

4. An apparatus according to claim 3 further including drive and linkage means for pivoting said stop means and ejector means.

5. An apparatus according to claim 2 further comprising carriage means for locating thereon the slide means, ejector means, and stop means and a common drive means for moving said slide means, stop means and ejector means.

6. An apparatus accurding to claim 2 further comprising clamping devices for securing the boards advanced into the cutting planes of the cutting means.

7. An apparatus according to claim 2, wherein said stop means, ejector means and slide means are adjustable along the longitudinal direction of the boards for varying lengths of the boards to be trimmed.

8. An apparatus according to claim 2, wherein the cutting means comprises a common cutting tool for forming the two cutting planes.

9. An apparatus according to claim 8, wherein the cutting tool is a milling cutter rotating about a vertical axis.

10. An apparatus according to claim 2, wherein the cutting means comprises a first saw for forming the first cutting plane and a second saw for forming the second cutting plane.

11. An apparatus according to claim 2, wherein the cutting means comprises a first milling cutter for forming the first cutting plane rotating in the vertical axis and a second milling cutter for forming the second cutting plane rotating about a vertical axis.

12. An apparatus according to claim 11, wherein the two milling cutters are displaced relative to one another in their feed direction.

13. An apparatus according to claims 11 or 12, wherein the milling cutters have a stepped profile and are arranged in such a way that the largest diameter portion of one milling cutter is associated with the smallest diameter portion of the other milling cutter.

* * * * *